US006073626A

United States Patent [19]

Riffe

[11] Patent Number: 6,073,626

[45] Date of Patent: Jun. 13, 2000

[54] FLEXIBLE CONFORMING DIVER'S AND SWIMMER'S SNORKEL

[76] Inventor: Jay T. Riffe, 23821 Marmara Bay, Dana Point, Calif. 92629

[21] Appl. No.: 09/070,336

[22] Filed: Apr. 30, 1998

[51] Int. Cl.[7] ..... B63C 11/16; B63C 11/02; A62B 9/04

[52] U.S. Cl. ..... 128/201.11; 128/201.27; 128/202.27

[58] Field of Search ..... 128/201.11, 201.27, 128/201.28, 202.14, 206.29, 202.27; 403/56, 142, 76

[56] References Cited

U.S. PATENT DOCUMENTS

| | | | |
|---|---|---|---|
| 1,695,263 | 6/1928 | Jacques . | |
| 4,466,434 | 8/1984 | Brownstein | 128/207.14 |
| 4,648,733 | 3/1987 | Merkt . | |
| 4,787,655 | 11/1988 | Gross et al. . | |
| 4,856,822 | 8/1989 | Parker . | |
| 4,898,490 | 2/1990 | Herbermann et al. | 403/56 |
| 4,928,710 | 5/1990 | Campbell . | |
| 5,046,764 | 9/1991 | Kimura et al. . | |
| 5,143,059 | 9/1992 | Delphia . | |
| 5,199,422 | 4/1993 | Rasochs . | |
| 5,249,570 | 10/1993 | Cox . | |
| 5,267,556 | 12/1993 | Feng . | |
| 5,449,206 | 9/1995 | Lockwood . | |
| 5,487,379 | 1/1996 | Koshiishi . | |
| 5,606,967 | 3/1997 | Wang . | |
| 5,622,165 | 4/1997 | Huang | 128/201.11 |

*Primary Examiner*—John G. Weiss
*Assistant Examiner*—Todd M. Martin
*Attorney, Agent, or Firm*—Leonard Tachner

[57] ABSTRACT

A flexible diver's snorkel is disclosed having a mouthpiece fluidly connected to a plurality of flexible interconnected linked passages having plural joints for orientation of the linked passages in X Y and Z directions with respect to the passages of the multiple links. The snorkel can be configured to conform to the side of a user's face and has an arcuate upright section with an extension for extending behind a user's head.

2 Claims, 5 Drawing Sheets

FLEXIBLE CONFORMING DIVER'S AND SWIMMER'S SNORKEL

BACKGROUND OF THE INVENTION

1. Field of the Invention

The field of this invention is within the diving and swimming art. More particularly, it relates to a snorkel for breathing in the diving and swimming art which allows one to swim or place one's head under water and breath. It particularly relates to those snorkels which can be used with self contained underwater breathing apparatus, in the sport of snorkeling, or ocean swimming, collegiate fin swimming and snorkeling behind a towing device.

2. Background of the Invention and Prior Art

The prior art with regard to diver's and swimmer's snorkels as well as those used for snorkeling comprises various configurations. These configurations have generally incorporated a mouthpiece with a curved U or J shaped section extending from the mouthpiece. The mouthpiece generally has a purge valve so that water can be expelled from the mouthpiece.

The U or J shaped section extends upwardly along a user's face and side of the head in order to provide for an intake and exhaust opening which extends above a user's head. Often times, this opening is used for breathing when a swimmer is close to the surface and has his head down or when a diver is snorkeling or looking at various objects while swimming close to the surface.

Such snorkels have their upright portion with the opening generally attached to a diver's mask area. This can be in the form of a strap around the snorkel that attaches to a diver's mask strap.

In addition to the foregoing general features of snorkels used for diving and swimming, such snorkels have incorporated in some cases a single flexible joint. In other cases various configurations for utilization and the general purging of water are incorporated. Multiple closures for the upper portion of the snorkel to prevent ingress of water as well as various purging systems and configurations have been used in the mouthpiece area. This invention does not generally pertain to purging devices but rather to the conformation and configuration of a snorkel.

The snorkel of this invention allows for flexibility so that the snorkel can be configured and conformed to any particular relationship with the diver to enhance various snorkeling and diving as well as swimming functions.

In addition to the foregoing, the invention hereof incorporates a conforming snorkel that can be made of a single structure, or one having plural flexible joints. The single structure allows for the snorkel to wrap around a user's head by extending below the chin region to the back of a user's head and then upright for breathing purposes. In this particular configuration, the snorkel is a conforming snorkel for streamlined usage and for overall enhancement of various swimming and diving functions as will be set forth in the specification hereinafter.

In particular, this invention overcomes the deficiencies of the prior art by providing for a flexible snorkel that has a plurality of joints that are flexible in the range of flexibility as desired. These joints can be plural in number. This allows for a general flexibility of the snorkel for configuring it in close proximation to a user's face, under the chin, around the back of the head and upright.

Other features of this invention allow for the snorkel to be made of multiple links or joints. These multiple links or joints can be manually extended or decreased in number. Also, in order to provide for a streamlining of the multiple links, a flexible sleeve can be incorporated over the links or joints of the snorkel. Streamlining can also be provided by the outside shape of the joints or links.

As will be seen from the following specification, this invention is substantially different in its configuration, conformation, and overall ability to provide superior snorkeling, swimming, and utilization in various environments for which a snorkel is desired.

SUMMARY OF THE INVENTION

In summation, this invention comprises a flexible conforming snorkel that can be made of a plurality of flexible or non-flexible joints or links comprising a series of ball and socket joints joined between a mouthpiece fixture and the open end of a snorkel as well as providing for a head conforming snorkel which is streamlined and oriented for adapting to swimming, undersea hunting, and snorkeling needs.

More particularly, the invention includes a mouthpiece fixture having a mouthpiece, sump and a purge valve. The mouthpiece and purge valve incorporate a standard mouthpiece which can be emplaced in a user's mouth for breathing purposes. Extending from the mouthpiece is a purge valve area and sump which allows for residual water to gather and be purged. The mouthpiece and purge valve combination have an opening which can be connected to a rigid tube or a plural number of links or flexible joints. The flexible links or joints can incorporate ball and socket joints which can be sequentially oriented in number to create a continuous flow path of air from the mouthpiece to an opening at the end of the links, or connected to a terminal inlet and exhaust fixture.

The flexibility of the joints once assembled allow for conformative and configurative adaptation to a user's desires when swimming or snorkeling. The configuration furthermore enhances the ability to conform the snorkel to a user's facial configurations and around to the back of the head for streamlined swimming and snorkeling as will be described hereinafter.

In addition to the foregoing features, the snorkel can incorporate solid conforming sections which can be configured to wrap around a user's chin and facial area and extend backwardly to a user's head. The configurative conformation can then be extended upwardly behind a user's head. This particular configuration can also be provided with two or more joints in order to accommodate the conforming and configurative relationship of the snorkel.

All of the foregoing aspects of the snorkel when combined allow for improved snorkeling, swimming, and diving that has not been known in the art.

DETAILED DESCRIPTION OF THE PREFERRED EMBODIMENTS

Figure 1:
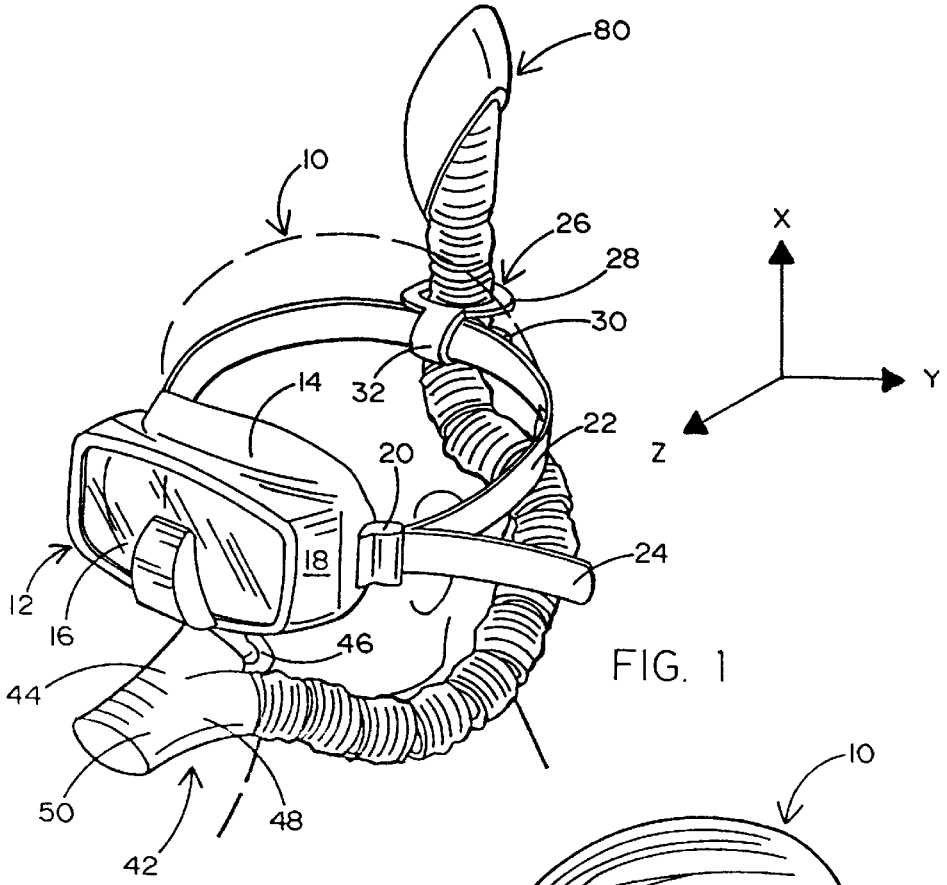
FIG. 1 shows a perspective view of a diver's head wherein the diver is wearing a mask and is using the snorkel of this invention comprised of a number of flexible links terminating in an upright member extending above the diver's head.
Figure 2:
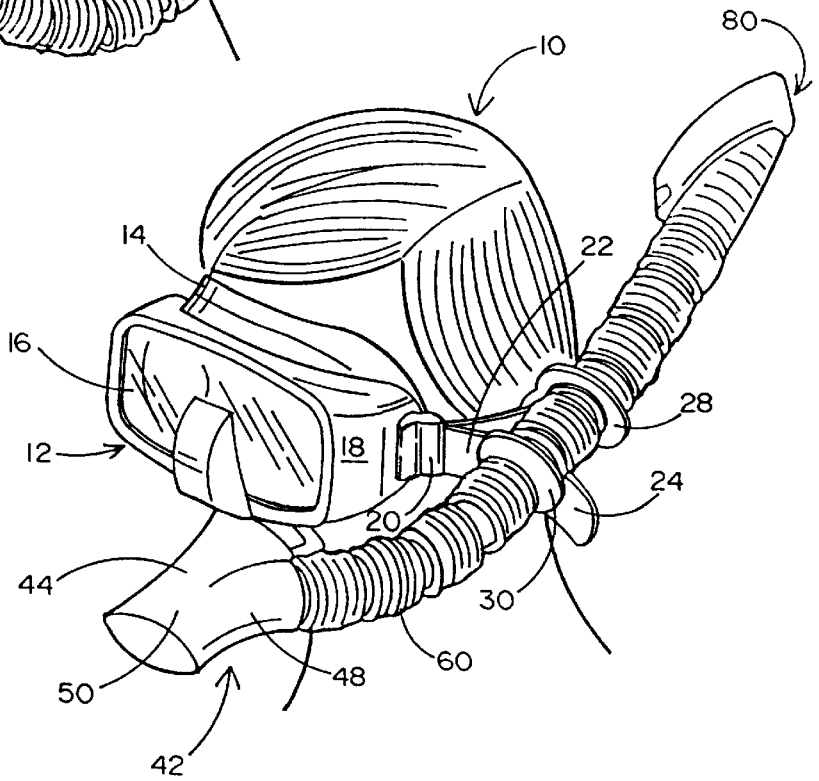
FIG. 2 shows a perspective view of the snorkel as shown in FIG. 1 attached to the side of the strap of the mask and extending beside a user's head in the normal manner in which most snorkels are used.

Looking specifically at FIGS. 1 and 2, it can be seen that a diver's head 10 is shown. The diver has a mask 12 used for purposes of providing underwater vision. The mask 12 has an elastomeric skirt 14 which surrounds the opening of the mask and is used to seal the mask to a user's face. The skirt 14 incorporates a lens or glass viewing portion 16.

The skirt 14 has side portions 18 on either side. The side portions 18 incorporate lugs 20 on either side. The lugs 20 generally have a well known method of attaching a strap 22 thereto such as a loop or buckle bar. The strap 22 as can be seen has a tail portion 24 which extends through the lugs 20 for adjustment purposes over the buckle bar.

The strap 22 is often used to hold a snorkel. This can be performed by a loop member 26 having an upper and lower islet or loop 28 and 30 which are connected by a cross member or web 32. The cross member or web 32 is looped around the mask strap 22 in order to attach it to a user's mask and in particular the strap.

Various types of loops and islets 28 and 30 can be utilized for attaching the snorkel to the mask strap. It is known for instance to have a single islet 28 forming the attachment 26 and in other cases means for attaching the snorkel to the mask in any other manner. Additionally, some divers do not care to attach the snorkel to the strap or the mask. Also in other cases, snorkels have been attached directly to the skirt 14 of the mask.

Regardless of the foregoing attachment means, any suitable attachment which accommodates the attachment of the snorkel to the mask or in adjacent relationship to a diver's head is deemed operable. This can be the loops 28 and 30 or other means to provide suitable functions for holding the snorkel to a diver's mask and/or in adjacent relationship to a diver's head.

The showings of FIGS. 1 and 2 show the snorkel of this invention with a Y branching mouthpiece fixture comprising a mouthpiece, sump and purge valve 42 hereinafter collectively referred to as a mouthpiece fixture. The Y branching mouthpiece fixture 42 incorporates a mouthpiece segment 44 having a mouthpiece which is inserted into a user's mouth which will be detailed hereinafter, namely mouthpiece 46 as well as a sump and purge valve. It also provides a branched connection portion 48 for connection to the flexible links or joints of the snorkel. Additionally, a sump and purge valve section 50 is shown. These respective elements constitute the mouthpiece portion or mouthpiece fixture 42 that is configured as a Y.

Attached to the mouthpiece fixture 42 are a plurality of ball joint links, joints, flexible connection members or flexible segments 60. These links or joints 60 are shown in greater detail in the remaining figures including FIGS. 6, 7, and 9. As can be seen in the remaining figures, the joints or links 60 comprise a ball joint configuration having a generally rounded section 62. This rounded male portion of a ball joint can be circular or of any configuration to accommodate the opposite linking portion of the joint. A female portion 64 which slides over the male portion 62 allows for a flexible connection with a relatively tight fit for maintenance. The flexible connection can be a flexible coupling 60 as shown having various configurations with greater lengths of the male and female portions to provide for greater flexibility. Also lesser flexibility can be provided depending upon the degree of flexibility required by limiting the interfacial movement between the respective portions 62 and 64. The movement is controlled by the length of the interfacing portion of the joints and their relative degree of roundness or interfacing arcuate curvatures.

Figure 9:
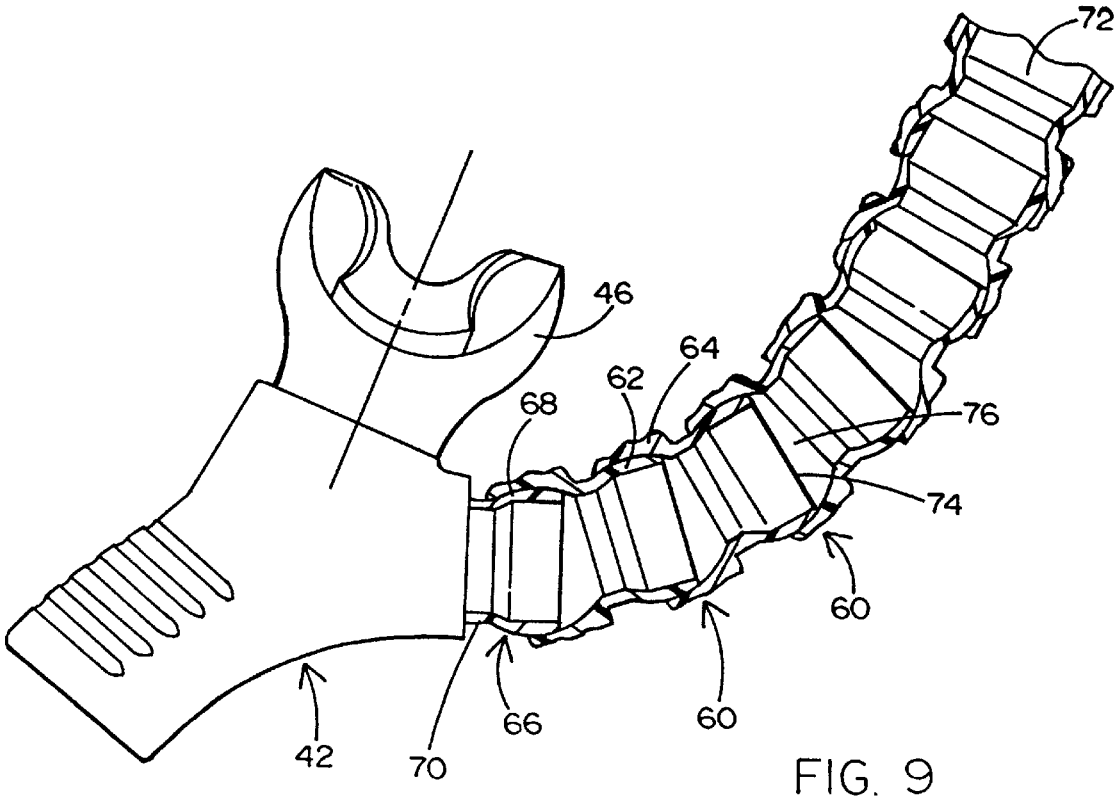
FIG. 9 shows a sectional view of the snorkel in part with the mouthpiece and purge valve sump section as sectioned through the flexible links of the snorkel.

The links 60 are connected to the mouthpiece and sump portion of the mouthpiece fixture 42 at a ball joint 66 which is formed as a portion of the mouthpiece fixture 42. The ball joint 66 has a circular rounded ball section 68 that terminates at a neck 70 that is formed as part of the mouthpiece fixture 42. This is seen in FIG. 9.

The respective links or joints 60 are interconnected in plural manner and have a passage 72 that extends through their axis from one link 60 to another. As can be seen, their interfacing joints 74 and 76 show an angular orientation whereby they have been bent in a curve upwardly as seen in FIG. 9.

The ball joint 66 with its ball segment 68 has been shown with a convexedly curved or rounded portion. This rounded portion as well as that of the male portion 62 and the matching female portion 64 can be of any particular curve providing for even greater flexibility. In other words, if the arcuate segment of the male and female portions extends in a more rounded configuration, they can allow for greater flexibility and angular displacement between the joints without dislodging.

The ball joints 60 can also be configured so that the male and female portions 62 and 64 can be disassembled by a manual dislodgment of each so that various segments can be emplaced depending upon the length that is desired or the particular colors of various configured joints 60.

The flexible joints 60 can also be modified in various colors so that various color combinations can be utilized. In other words if a custom snorkel is desired by a user, one can substitute the joints 60 with variably colored joints by manually disengaging the various joints from their ball and socket relationships. Insertion of various colors can also be utilized or custom features such as a diver's name on a particular ball joint 60 or a color for a dive club or the name of a diving organization. As can be seen great flexibility is provided with regard to the changing and re-configuring of the various joints 60.

Figure 5:
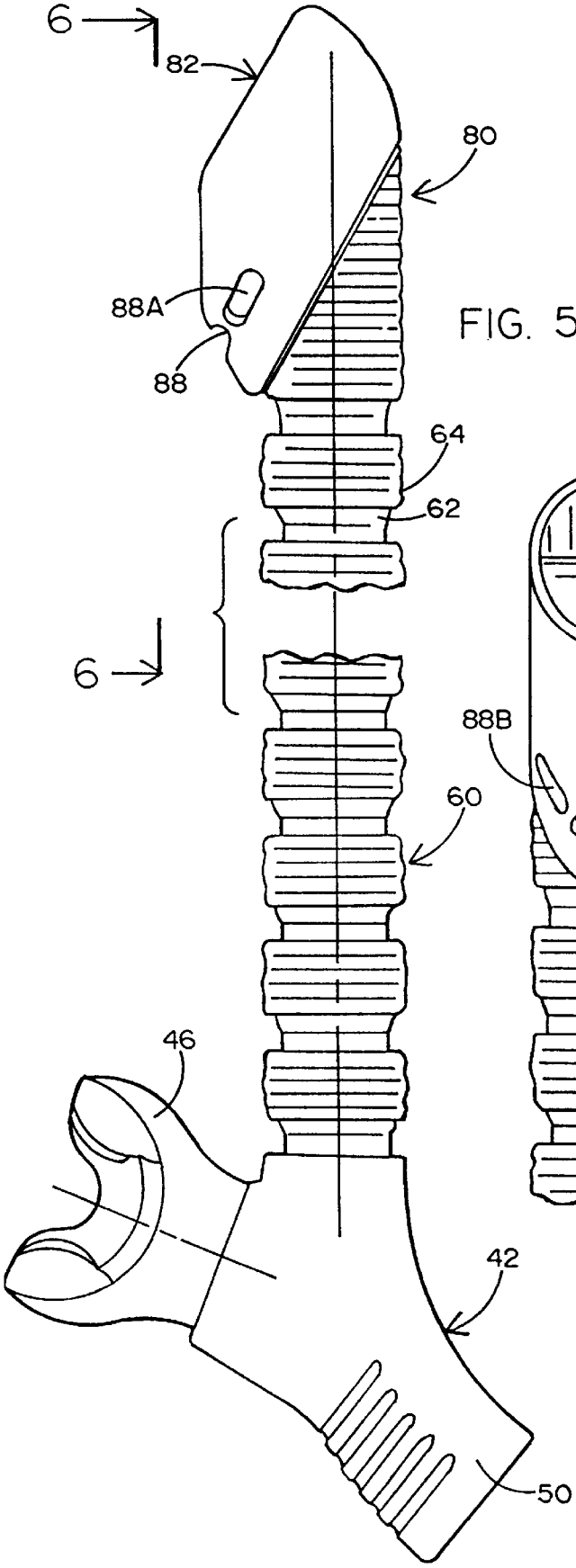
FIG. 5 shows a fragmented side elevation view of the snorkel of this invention with the multiple links or joints detailed therein.
Figure 6:
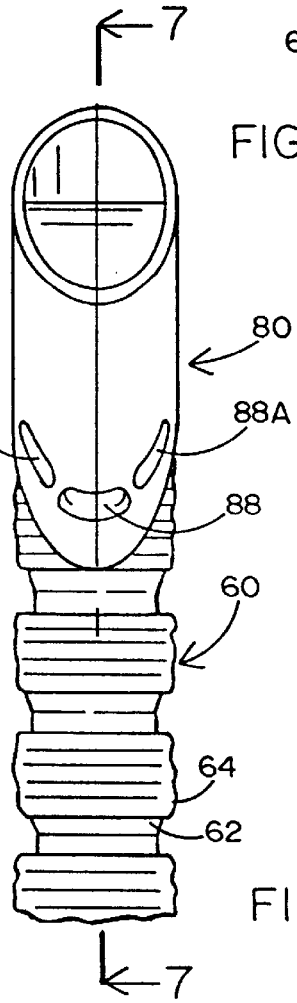
FIG. 6 shows a view looking from the side of the snorkel along lines 6—6 of FIG. 5.
Figure 7:
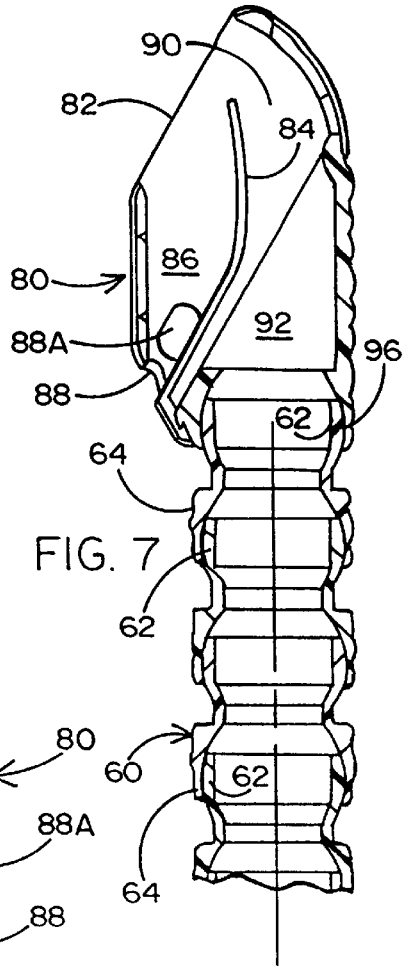
FIG. 7 shows a sectional view along lines 7—7 of FIG. 6.

Looking more particularly again at FIGS. 5, 6 and 7, it can be seen that the mouthpiece fixture 42 includes a mouthpiece 46 and a purge valve section 50. This is connected by the ball joint 66 to the flexible ball joint 60.

The ball joints 60 terminate in an inlet and outlet fixture 80. The inlet and outlet fixture 80 can be seen in FIGS. 5, 6 and 7 having a sloping opening 82. The sloping opening 82 includes a baffle 84 interposed therein to allow for water to be drained therefrom. The baffle 84 traps water in a sump 86 that drains outwardly through openings 88, 88*a* and 88*b*. These respective openings 88, 88*a* and 88*b* allow for the drainage of water that is caught in the sump 86 so that it can flow outwardly. The inlet and outlet of air for the user passes through the opening 82 and downwardly into the interior opening 90. Opening 90 interconnects with the interior 92 of the fixture which is in turn connected to the passage 72 created through the links or joints 60 forming the flexible portion of the snorkel.

The fixture 80 has a female portion of a ball joint 96 which interconnects to a male joint 62 of a male portion of one of the joints 60. Thus, the fixture 80 can be moved in relationship to the ball joint segments 60 to provide for flexibility at the terminal portion of the fixture. Additional, flexibility is provided at the mouthpiece fixture 42 at the connection 66 having the ball section 68 thereof for movement of a female portion 64 of a ball joint connect 60.

The mouthpiece fixture 42 incorporates the ball joint 66 with its male ball portion 68. Additionally, a mouthpiece fitting 91 is shown which can receive the mouthpiece 46 over the ridges or tangs 93 thereof. These particular tangs or ridges secure the mouthpiece 46 by standard means of allowing the mouthpiece to be stretched thereover and received within the grooves 95 as well as over the tangs or ribs 93.

The mouthpiece and sump portion also incorporates a purge valve section having a series of cross webs two of which are shown as webs 98 and 100. The webs support a mushroom shaped purge valve 102 so that water can be expelled from a sump section 104 in the purge valve section of the mouthpiece fixture 42. The sump 104 can be of any sufficient capacity to hold water therein that has been drained thereinto. It passes outwardly through the purge valve 102 when a positive pressure is exerted in the sump area 104 through the mouthpiece 46 when a user blows downwardly thereon. The foregoing allows for an efficient discharge of water in the sump 104.

Figure 3:
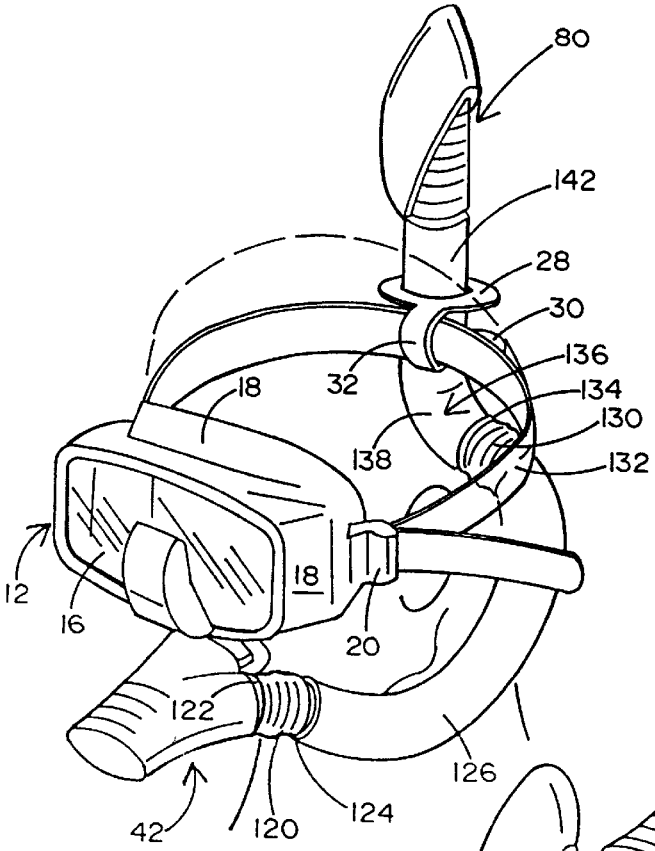
FIG. 3 shows the snorkel of this invention having two fixed or non-bending portions, one conforming to the side of a user's head and the other to the back of a user's head, both of which are joined by a flexible joint.
Figure 4:
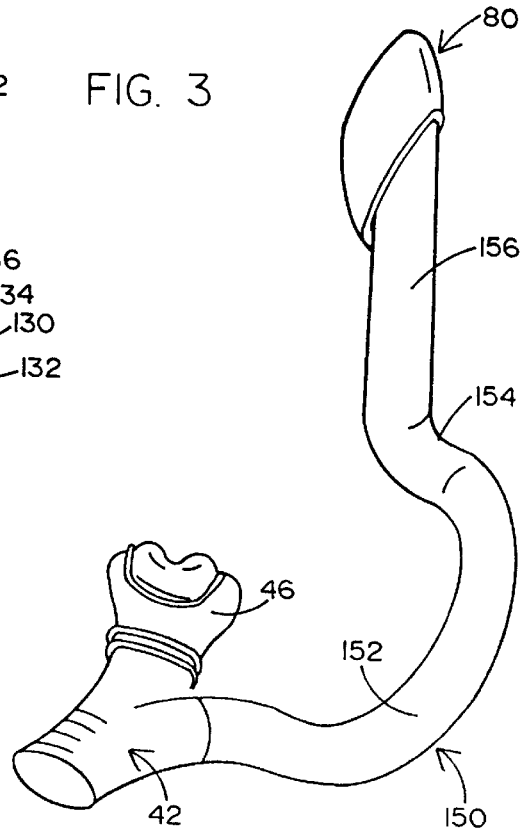
FIG. 4 shows a perspective view of the snorkel of this invention which is one solid conforming snorkel which conforms generally to the face and head of a user to extend around the face and head and then upwardly behind a user's head.
Figure 4A:
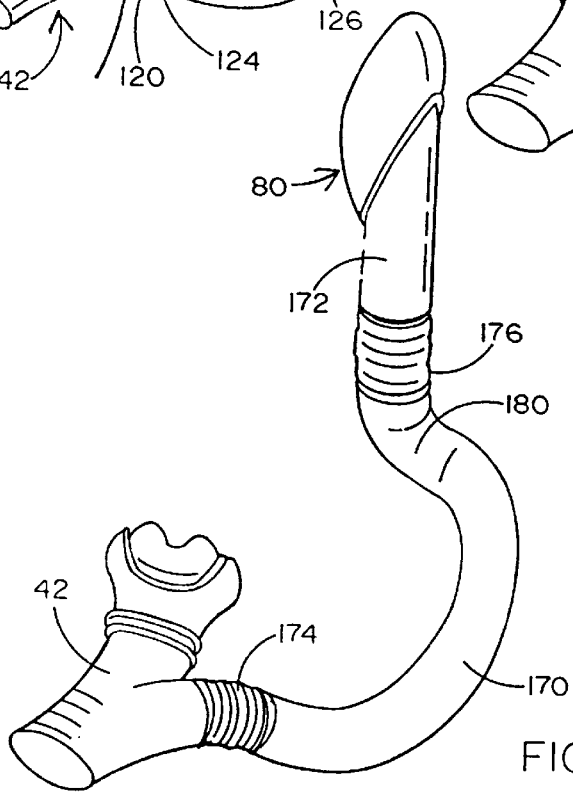
FIG. 4A shows a snorkel similar to that of FIG. 4 wherein two portions of the snorkel which are solid or solidly configured are joined by flexible joints.

Looking more particularly at FIGS. 3, 4 and 4A, it can be seen that the snorkel of this invention in FIG. 3 shows a flexible link or joint 120 analogous to the connection or joint 60 connected to the mouthpiece fixture 42 at a connection 122 and a second connection 124. The second connection 124 is in turn connected to a solid tubular structure 126. The solid tubular structure 126 is configured and curved to generally underlie a user's chin and to curve around to the back of a user's head. The arcuate curve 126 can approximate the curve around a user's head under the chin area and to the back where it is connected by a second flexible link 130 having connections 132 and 134. Connections 132 and 134 are analogous in linking the tubular portion 126 to connections 122 and 124.

The connection 134 is connected to an upright curved portion 136 made of a solid tubular structure. The upright portion 136 has a curve 138 which extends upwardly at approximately anywhere from a 60° to 120° angle from the joint 130 to form an upright extending portion 142 terminating in the exhaust and inlet fixture 80.

The exhaust and inlet fixture 80 can be of any suitable configuration. However, in this particular instance it has been shown as the exhaust and inlet portion as detailed in FIGS. 5, 6, and 7.

The upright portion 142 extends upwardly from the back of a user's head so that it emerges above the user's head but can also be at approximately the user's head level. Suffice it to say, this provides for a more streamlined configuration in conformance to wrapping in a smooth manner around a user's head with the solid portion 126 and upright portion 136 terminating in the upright 142. Variously curved configurations can be customized to suit the needs of a particular diver and a particular head configuration so that various sizes and conformations can be made. Also, the flexibility of joints 120 and 130 can be altered so that they can be single joints wherein the male or female portion is formed with for instance the mouthpiece fixture 42 having a male or female ball joint connected to the solid portion 126 having a respective male or female joint. In like manner, joint 130 can be substituted so that the solid curved segment 126 can have a male or female segment and a solid curved section 136 can have a respective male or female section connected thereto.

Looking more specifically at FIGS. 4 and 4A, it can be seen that FIG. 4 shows a mouthpiece fixture 42 solidly connected to a singular tube 150 having a curved segment 152. This approximates the curved area near a user's chin and neck to curve around and terminate at an upward arcuate angle 154. This arcuate angle 154 is anywhere from 60° to 120° to allow for an upright 156 to extend upwardly and terminate in an analogous inlet and exhaust portion 80 behind a user's head.

The entire snorkel of FIG. 4 with the major curved portion 150 curves around to be configured to a user's lateral area near one's chin, neck and back of the head and then extend upwardly with the upright 156. This provides for a streamlined exhaust and inlet area 80 for breathing purposes so that the snorkel is not in the way of the user's face but terminates in the back region of a user's head.

FIG. 4A shows a snorkel having a solid tubular section 170 connected to an upright 172. Here again, joints 174 and 176 are shown interconnecting in the manner of joints 120 and 130. Joints 174 and 176 can either be analogous to the ball joint 60 or be fitted with respective male and female portions to the respective tubular portions 170 and 172. Also, an exhaust and inlet fixture 80 is shown connected to the upright portion 172.

In the particular embodiment of FIG. 4A, it can be seen where the upright tubular portion 172 is a straight upright tubular or pipe section without the curve 138 or 154. The curve in order to provide the upright relationship is a portion of curved tube 170 and constitutes curved section 180 thereof. Curved section 180 again can be in the range of 60° to 120° so as to allow for an upright orientation of the upright tubular pipe 172.

The tubular section 170 can be formed in any suitable curved portion to allow for the termination in a generally upright configuration to allow for the upright 172 to extend therefrom. Also, the flexibility of the joint 176 creates a situation wherein variable comfort zones can be created by moving the upright tubular portion 172 in various axial orientations to its axis.

Figure 10:
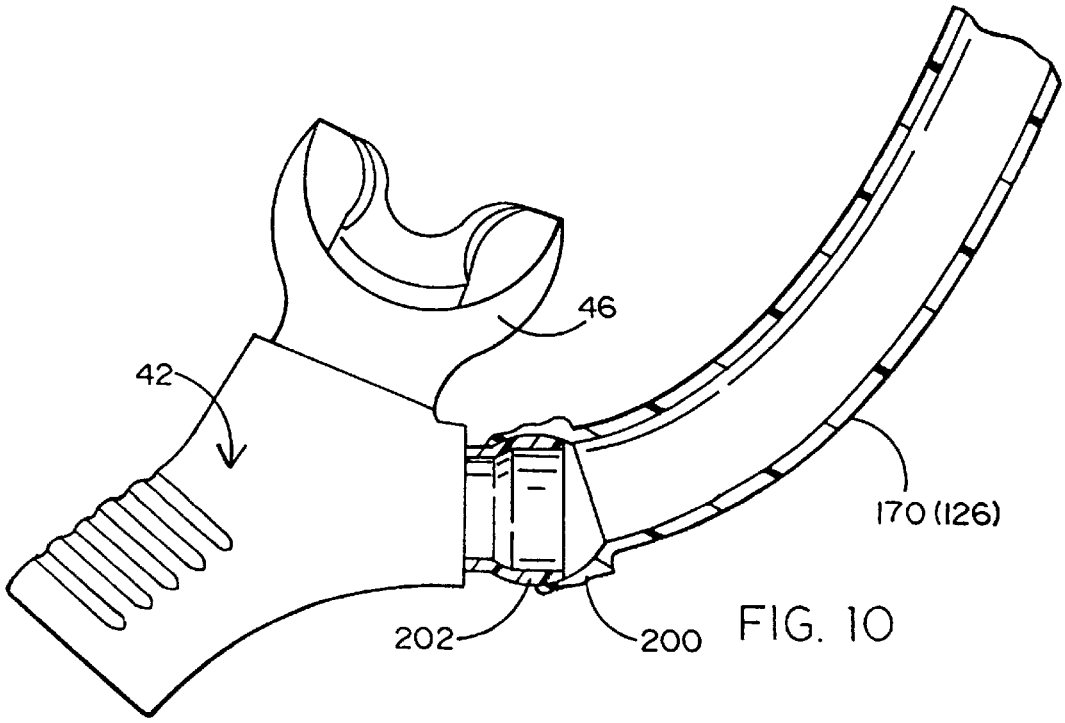
FIG. 10 shows the same mouthpiece sump and purge valve of FIG. 9 with a sectioned solid non-bending segment for conforming to a user's head as flexibly attached to the mouthpiece sump and purge valve.

The alternative connection where the male or female ball joints can be molded into the tubes 170 or 126 and the mouthpiece fixture 42 has been shown in FIG. 10. Here the curved tubular portion that extends around a user's chin and neck 170 or 126 has been shown connected with a female connection in the form of a ball joint 200 and a male ball joint. connection 202. These two respective connections are shown in cross-section in their connected manner to provide for flexibility that has been referred to in FIGS. 3 and 4A.

Figure 8:
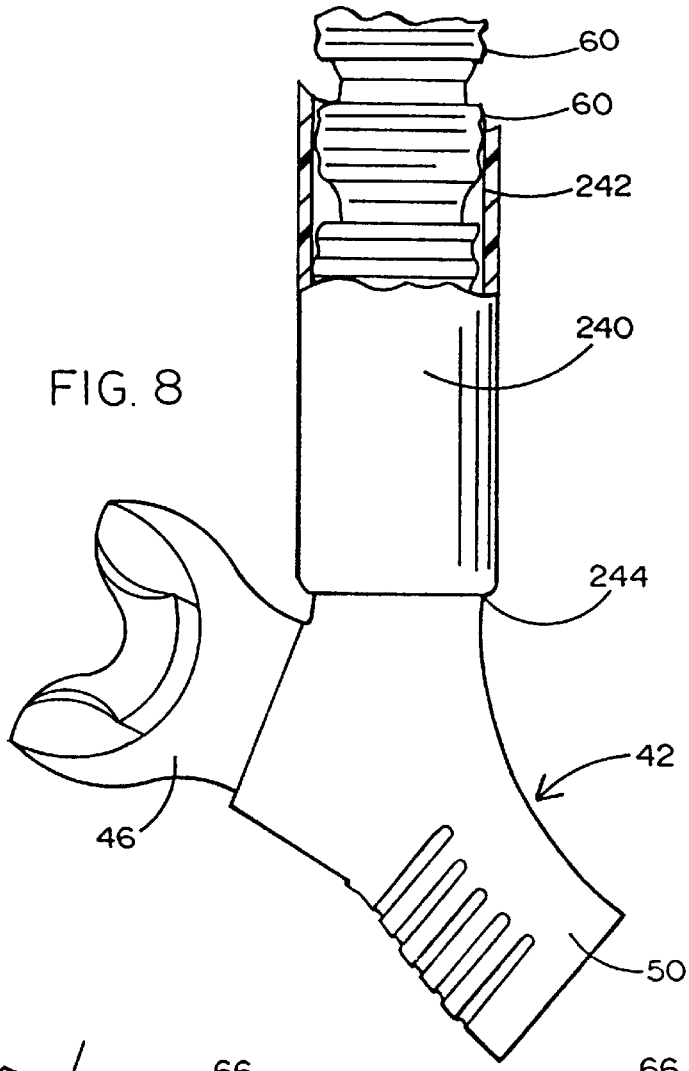
FIG. 8 shows a view of the mouthpiece fixture including the sump and exhaust valve connected to flexible links of the snorkel as sheathed with a flexible sheath.
Figure 11:
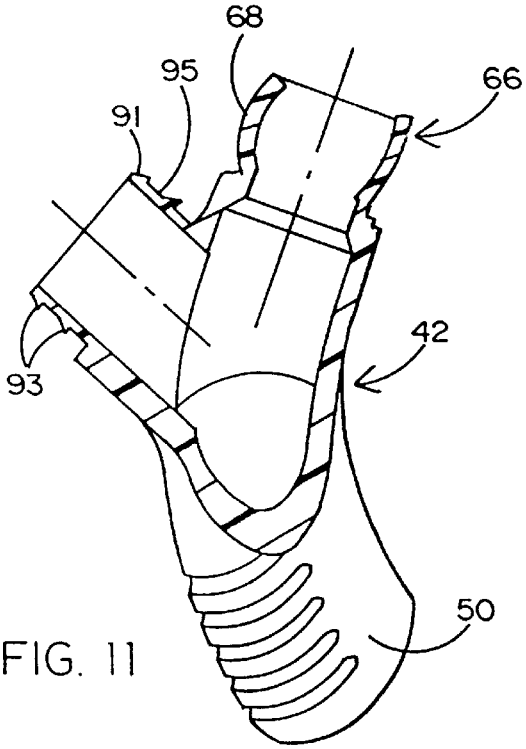
FIG. 11 shows a partially sectioned view of the purge and sump portion of the snorkel.
Figure 12:
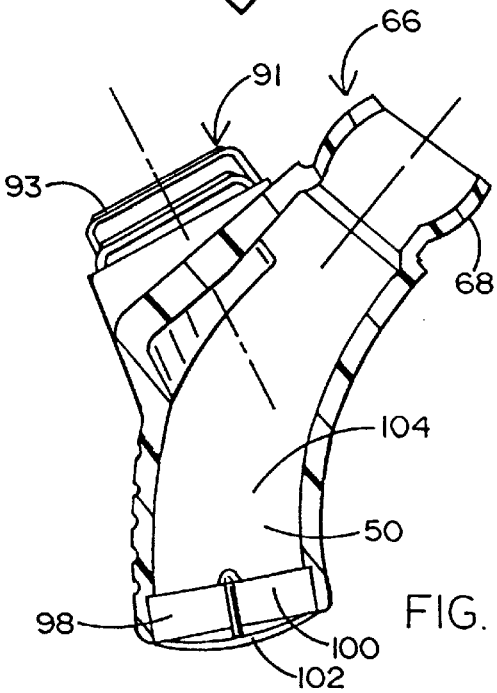
FIG. 12 shows a partially sectioned view of the sump and purge valve portion generally through the midline thereof.

Looking more particularly at FIG. 8, it can be seen where multiple ball joints, links or connections 60 are shown connected to the mouthpiece fixture 42. In order to provide for further streamlining, a sheath 240 is shown having a cross-sectional thickness 242 sufficient to allow for bending and at the same time a streamlined orientation. Additionally, the sheath 240 can be secured at point 244 to the mouthpiece fixture 42. Also, it can be secured at the other portion to the exhaust and inlet fixture 80. This allows for an accommodation of a flexible smooth snorkel while at the same time creating multiple joints 60 that can flex.

As can be seen from the foregoing, this invention comprises a flexible snorkel as well as one that can be configured to a user's head to allow for exhaust to the rear of a user's head. Also, as shown in FIG. 2, the snorkel can be secured to the side and allowed to provide exhaust and inlet through exhaust and inlet fixture 80 when a user's face is normally turned down.

The other snorkels shown in FIGS. 3, 4, and 4A can be attached as shown with the round loops 28 and 30 connected by a web 32 around a user's mask strap 22. These loops 28 and 30 have not been shown in FIGS. 4 and 4A but can be used to accommodate and orient the user's snorkel in such a manner. Also, the configurations generally can have a combination of loops 28 and 30 as shown attached to the mask strap in FIG. 2 or in FIG. 1 or both for greater positioning and securement of the snorkel to a user's mask and in the side and rear portions as shown respectively in the various figures. Thus, various attachment configurations can be utilized including any suitable elastomeric or semi-elastomeric attachment to a mask or a fixed attachment to a mask or a user's mask strap.

As seen in FIG. 1, an X, Y and Z orientation has been shown. This fundamentally is to illustrate that the snorkel of FIGS. 1, 2, 3, and 4A and the ancillary figures attendant therewith can be provided with an X, Y and Z orientation. This allows for the snorkel to be oriented in any suitable manner to accommodate the comfort of a user. Also, the snorkel provides for movement in the X, Y and Z orientation to maintain orientation for instance in a Z orientation in the axis of a user's mouth, the Y orientation in the lateral relationship and the X orientation in the upright relationship of the snorkel to a user's head.

With this in mind, it should be appreciated that various configurations and orientations can be utilized with this invention to maintain the snorkel in the manner which is most comfortable and at the same time most efficient for streamlined operation.

Such snorkels when streamlined can be used for ocean swimming, fin swimming, collegiate fin swimming activity, and underwater hockey. Furthermore, various color combinations can be used through the variable joints 60 and extensions and modifications in length and lateral orientation with regard to the X, Y and Z directions can be provided to the snorkel. This increasing and decreasing in length also serves to maintain variability. With the thought that the manual separability of the joint 60 is easily maintained, it can be appreciated that this snorkel has a wide variety and diversity of uses as claimed hereinafter.

What is claimed is:

1. A flexible snorkel comprising a mouthpiece fluidly connected to a first one of a plurality of serially interconnected ball and socket joint links, said links forming an elongated continuous flexible air passage from said mouthpiece to a last one of said plurality of links, said links being manually separable from and reconnectable to one another to permit selective modification of the length of said snorkel with the removal or addition of said links in said plurality.

2. The flexible snorkel recited in claim 1 wherein said serially interconnected ball and socket joint links are interconnected with sufficient friction for said snorkel to retain its shape after said links are adjusted in angle relative to one another.

* * * * *